United States Patent [19]

Pereau

[11] 3,983,946

[45] Oct. 5, 1976

[54] AUTOMATICALLY REPOSITIONABLE ROTARY PLATFORM, AND METHOD

[75] Inventor: Robert L. Pereau, Irvine, Calif.

[73] Assignee: Smith International, Inc., Newport Beach, Calif.

[22] Filed: Mar. 19, 1975

[21] Appl. No.: 559,913

[52] U.S. Cl. ..... 173/1; 175/57; 175/161; 212/39 R; 212/67

[51] Int. Cl.[2] ..... B66C 13/48

[58] Field of Search ..... 175/161, 84, 88, 57; 173/1; 212/39 R, 28, 66–69

[56] References Cited

UNITED STATES PATENTS

| | | | |
|---|---|---|---|
| 3,445,014 | 5/1969 | Kullerback | 212/39 R |
| 3,447,692 | 6/1969 | Thomas | 212/39 R |
| 3,664,515 | 5/1972 | Ovendorff et al. | 212/39 R |
| 3,696,625 | 10/1972 | Alexander | 173/27 X |

*Primary Examiner*—Ernest R. Purser
*Assistant Examiner*—William F. Pate, III

[57] ABSTRACT

A derrick-type augur drill machine mounted on a carrier, including a rotary platform having both a memory device and an automatic latching means associated with the memory device, the memory means being operable for storing information indicating a selected rotary position of the platform and the latching means being responsive to the stored information when the selected platform position is regained for locking the platform in place. An apparatus and method for automatically repositioning a rotary platform are also disclosed in detail.

20 Claims, 15 Drawing Figures

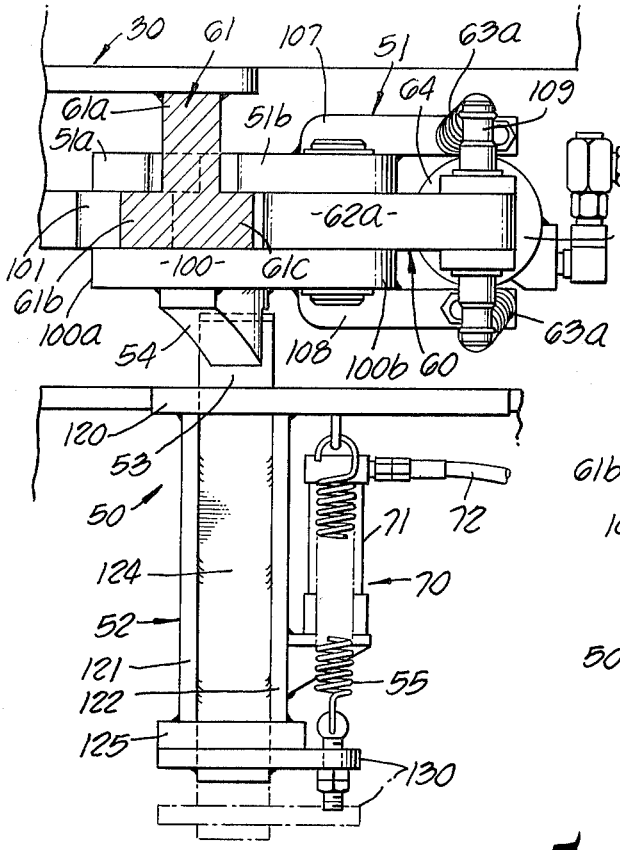
FIG. 9.
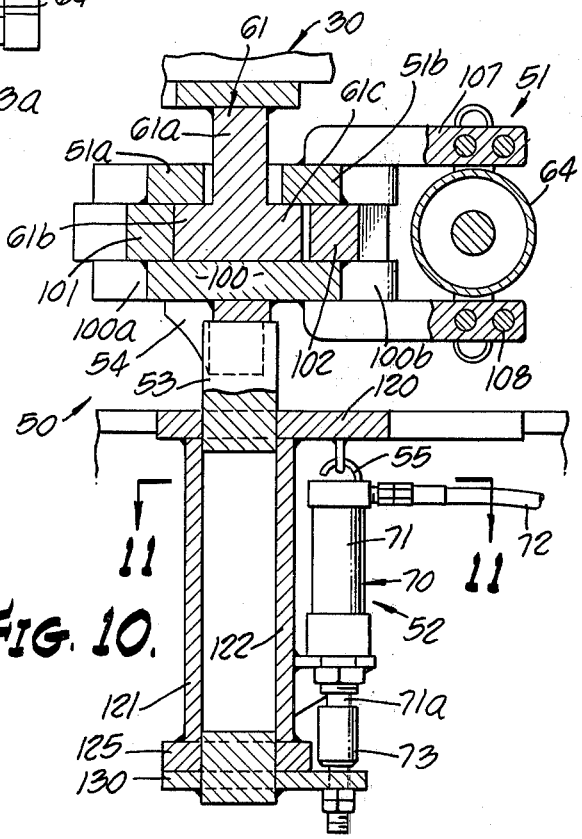
FIG. 10.
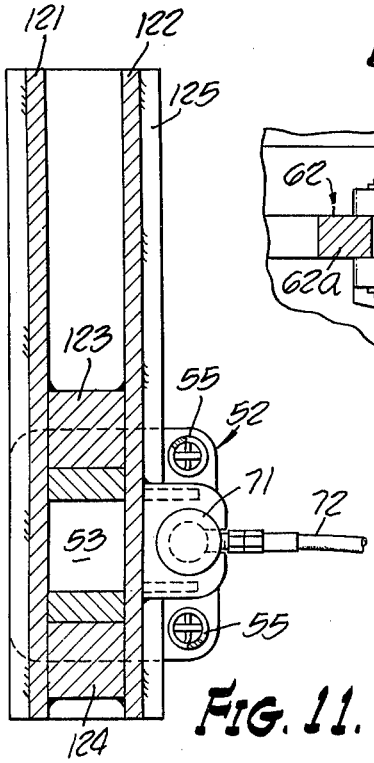
FIG. 11.
FIG. 12.
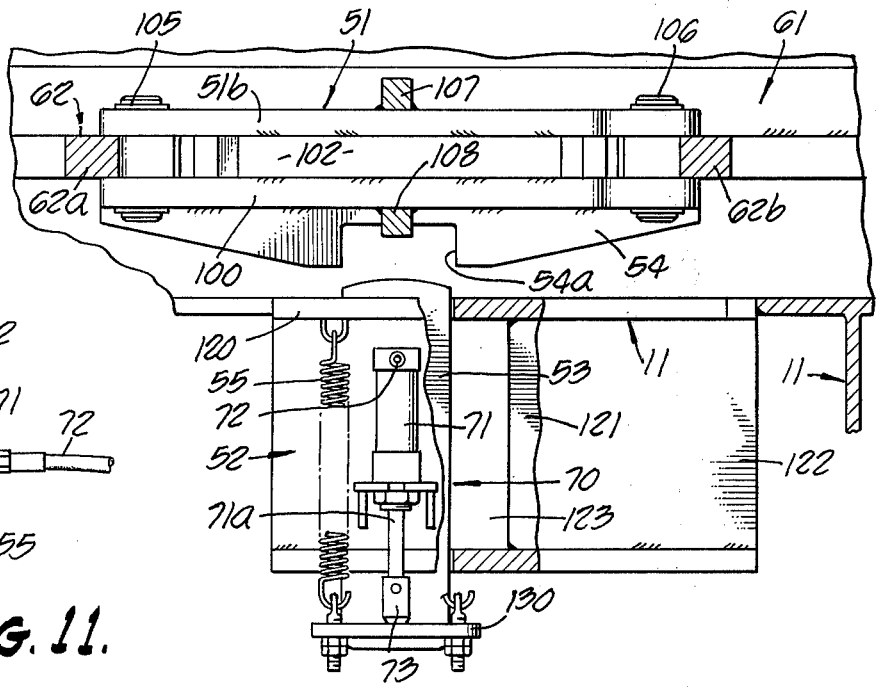

AUTOMATICALLY REPOSITIONABLE ROTARY PLATFORM, AND METHOD

BACKGROUND OF THE INVENTION

There may, perhaps, be various situations in which it is desirable to be able to automatically reposition a rotary platform to a selected position which it occupied initially.

While the present invention appears to be generally applicable to rotary platforms, and the method of automatically repositioning same, it has found its initial application to a particular type machine, namely, a vertical augur drill carried by a derrick that is in turn supported on a rotary platform, the rotary platform being transportable by a wheeled carrier.

In operating a vertical augur drill for drilling water wells and the like it is periodically necessary to lift the augur from the hole in order to shake out the cuttings. Before shaking out the cuttings, however, the augur must be moved considerably to one side of the hole, in order to avoid having the cuttings fall back down into the hole. When the augur is carried by a derrick that is in turn supported from a rotary platform, it is, therefore, the practice to rotate the rotary platform a number of degrees in one direction or the other before shaking the cuttings from the augur. When the cuttings are shaken from the augur the rotary platform is then returned to its initial position, and the augur is again lowered into the hole for further drilling of the hole.

In such operation of a vertical augur drill it has heretofore been the practice for the operator of the machine to manually control the movements of the rotary platform, including both the rotation of the platform away from the hole before the augur is shaken, and the rotation of the platform back to the hole after the shaking action has been completed.

SUMMARY OF THE INVENTION

According to the present invention an automatic means is provided for repositioning a rotary platform to a selected initial position.

Further in accordance with the present invention, the automatic positioning means may be applied to a vertical augur drill, and when so applied it speeds up the drilling procedure and also avoids errors in the repositioning of the rotary platform, which errors might produce an irregular shape at the top of the hole that would be undesirable.

Not only does the present invention disclose a particular automatic repositioning mechanism, but it also provides a method of repositioning a rotary platform, and the practice of the method requires only a memory device for storing information indicating a selected initial position of the platform together with an automatic latching means which is responsive to the stored information for locking the platform in place when its desired initial position has been regained.

DRAWING SUMMARY

FIG. 9 is an elevational view of the latch mechanisms, partially in cross-section, taken on the line 9—9 of FIG. 7;

FIG. 10 is a cross-sectional elevational view of the latch mechanisms taken on the line 10—10 of FIG. 7;

FIG. 11 is a fragmentary cross-sectional view taken on the line 11—11 of FIG. 10;

FIG. 12 is a view similar to FIG. 7 but showing the two latch parts when disengaged;

GENERAL FORM OF THE INVENTION

Figure 1:
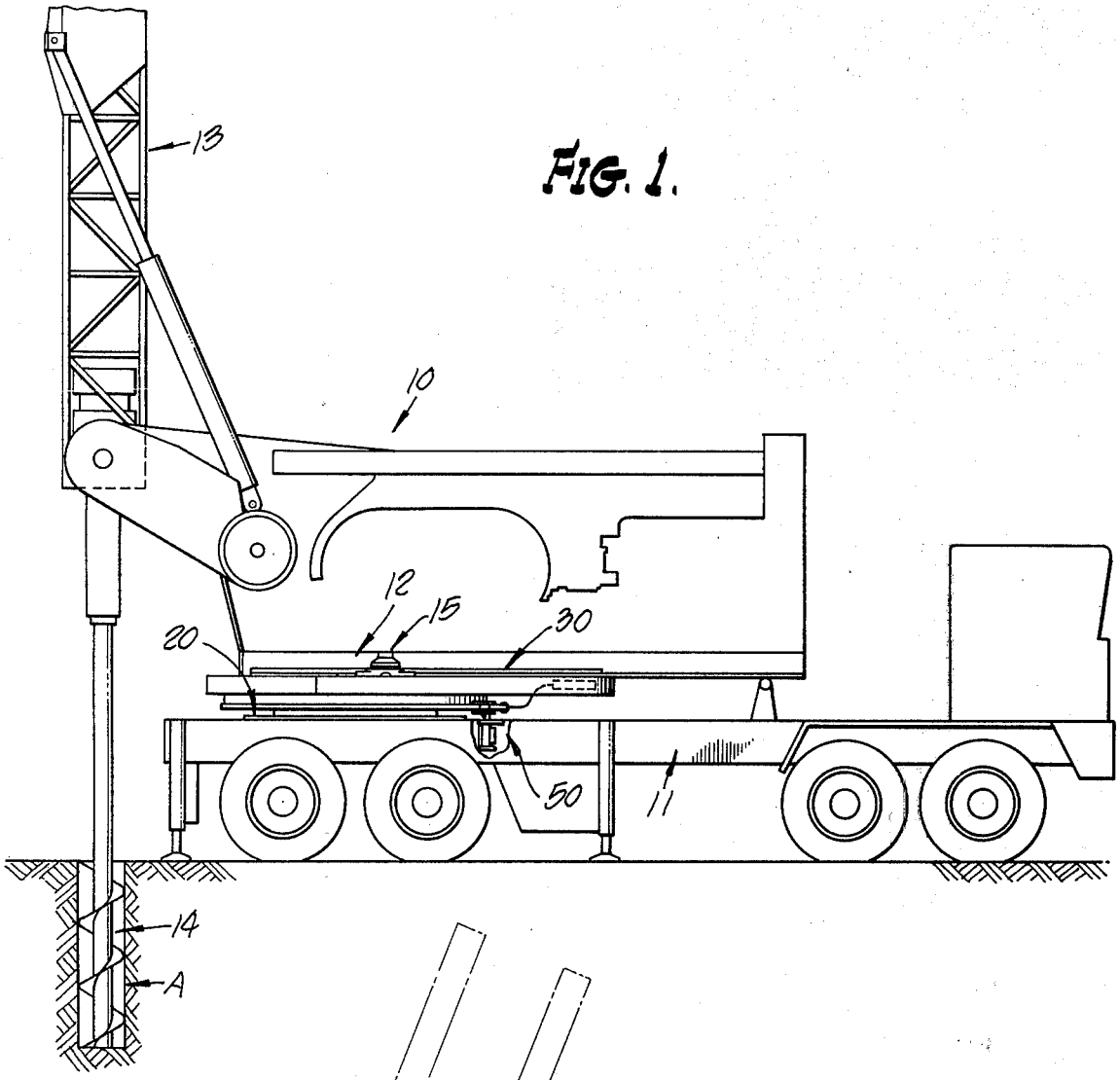
FIG. 1 is a vertical elevational view of a drilling rig in accordance with the present invention, while drilling a vertical hole in the ground.

The invention in its general form provides a method of automatically repositioning a rotatable platform to an initially selected position of rotation. The rotatable (or rotary) platform is selected to have a memory device which is operable for storing information indicating the initially selected rotary position. When the platform is placed in its initially selected position the memory device is activated, thus storing information which will indicate this selected position at a later time.

The rotary platform is also equipped with an automatic latching means, the latching means being associated with the memory device and responsive to the information stored therein for automatically locking the platform in place whenever its selected initial position is regained.

The general form of the invention also includes control means for disengaging the latching means, so that the rotary platform may be rotated away from its initially selected (normally locked) position.

The invention in its general form also includes means for de-activating or erasing the memory. The stored information must be erased whenever it is desired to select a new initial (or normally locked) position of the rotary platform. After the memory has been erased, the platform is moved to its new selected position, and the memory is again activated for storing information indicating the new selected position of the platform.

The general form of the invention may be carried out by utilizing a mechanical brake, electrical means sensing the rotary position of the platform, electronic memory means for storing information indicating a selected rotary position of the platform, and electrical means responsive to the stored information for initiating the operation of the brake when the selected platform position has been retained.

Alternatively, both the memory device and the brake may be constructed in mechanical form as disclosed in the present drawings.

SPECIFIC FORM OF THE INVENTION

According to the specific form of the invention disclosed herein a rotary platform assembly includes a base, a rotary platform upon the base for rotation thereon, and means for drivingly rotating the platform. A circular track is secured to the undersdie of the platform. A first (upper) latch part is mounted on the circular track so as to slide circumferentially around the track. A second (lower) latch part is attached to the base. One latch part is equipped with a spring-loaded latch bolt and the other is equipped with a striker plate.

The memory means includes a remotely controlled brake, carried by the upper (first) latch part and which is selectively operable for locking the upper latch part in a selected circumferential position on the track. Initiating the braking action so as to lock the latch part in place constitutes a storage in memory of the initially selected (normally locked) position of the rotary platform.

Remotely controlled means is also provided for withdrawing the latch bolt so as to disengage the two latch parts, in order that the rotary platform may be free to rotate away from its initially selected (normally locked) position.

When the information in memory is going to be destroyed, the two parts of the latch are not disengaged but are kept in their locked position. The release of the brake permits the rotary platform to rotate even though the upper latch part remains secured to the lower latch part, which in turn is securely fastened to the stationary base. The rotatable platform rotates but the upper latch part remains stationary, and hence there is a relative movement of the circular track relative to the upper latch part. When a new initial (normally locked) position of the rotary platform has been reached, the remotely controlled brake is energized and the upper latch part is thereby secured to the track. The two latch parts may be disengaged from each other in order to permit further rotation of the rotary platform, but the information as to the initially selected (normally locked) position of the platform has now been stored in the mechanical memory again.

PREFERRED EMBODIMENT

Reference is now made to the drawings, FIGS. 1 through 11, inclusive, illustrating the presently preferred form of the invention.

A vertical augur drill machine 10 includes a wheeled carrier 11, a rotary platform assembly 12, a derrick 13 supported on the rotary platform, and an augur 14 carried by the derrick. The overall machine is shown in FIG. 1. As there shown the carrier 11 is parked in a fixed location and the augur 14 is drilling a hole A in a location near to the drilling rig. While not specifically shown in the drawings, the flutes of augur 14 become filled with dirt as the drilling progresses. The machine does not contain any separate system for removal of the dirt or cuttings. Therefore, when the augur becomes filled with dirt, it is necessary to retract the augur vertically upward within the derrick 13, and then by operation of the rotary platform assembly 12 to move the derrick to a new position where the dirt can be shaken from the augur.

Figure 2:
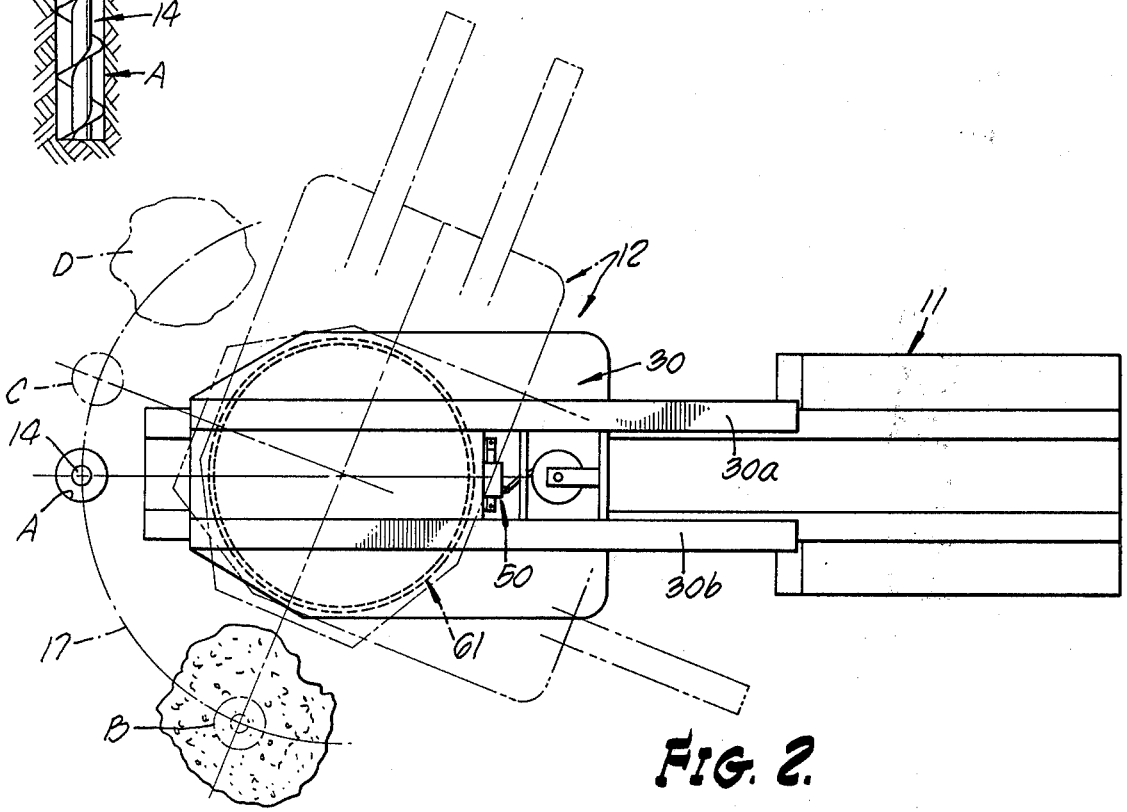
FIG. 2 is a schematic top plan view of the machine of FIG. 1 showing how the rotary platform is rotated in order to empty dirt from the augur.

Thus as shown in the plan view of FIG. 2 the augur after initially drilling a hole at A is swung around an arc 17 to a location B where the dirt is shaken out of the augur to form a pile on top of the ground. Then the derrick is swung around to its original position and the augur is again lowered for further drilling of the hole A. After hole A has been drilled to its full depth it may then be desired to drill another nearby hole C. Location C is on the opposite side of location A from the dumping site B. For drilling the hole at C it may then be desired to use a dumping site D which is located in the other direction. Hole C and site D are both shown in dotted lines.

In prior art machines it has not only been necessary for the operator to initially select the location of the hole A, but furthermore, each time that the auger is swung from the dump site B back to the hole A it is necessary for the operator to manually reposition the derrick so that the auger will be properly aligned with the hole. According to the present invention this repositioning is done automatically.

In prior art machines it would be necessary to select the drilling hole C under manual control, and again, to manually reposition the derrick each time the augur is swung from dump site D to the hole C. But here again, according to the present invention, the repositioning at hole C is accomplished automatically.

The rotary platform assembly 12 includes a base 20 that is affixed to the carrier 11, and a rotary platform which is essentially horizontal and is disposed above the base 20 and adapted to rotate relative to the base. Bearing support means 40 includes concentric rings 41 and 42, the ring 41 being attached to base 20 while the ring 42 is attached to rotary platform 30. The concentric rings together form a bearing race within which bearings 43 are located. The rotary platform 30 is in that manner rotatably supported upon the base 20.

Also included in the rotary platform assembly 12 is an automatic latching means 50. The latching means 50 includes a first or upper latch part 51 as well as a second or lower latch part 52. Interengagement means for the latch includes a bolt 53 which is slidably supported by the lower latch part 52 and a striker plate 54 carried on the upper latch part 51. A spring 55 biases the bolt toward the striker plate so that when the two latch parts move into aligned positions the latching action will automatically take place. See FIG. 14 which shows the latching action about to occur, and FIGS. 9 and 10 which show the locked position of the bolt 53.

Rotary platform assembly 12 also includes a memory means 60 for storing information which indicates a selected rotary position of the platform 30. Memory means 60 includes a circular track 61 which is attached to and depends downwardly from the rotary platform 30. Track 61 is concentric with and disposed about the bearing support rings 41, 42. Track 61 is of T-shaped cross-sectional configuration, having a vertical central base portion 61a and horizontal inner and outer flanges **61*b*, 61*c* on the lower edge of the base portion. The upper latch part 51 has fingers 51*a*, 51*b* which extend over and are slidably disposed upon the upper surfaces of the track flanges 61*b*, 61*c*, respectively. The first or upper latch part 51 is, therefore, able to slide circumferentially about on the circular track 61**.

Memory means 60 also includes a brake 62 for selectively locking the upper latch part 51 in a desired circumferential position on the track. Brake 62 having braking cams 62*a*, 62*b* is normally held in its unlocked position by spring means 63*a*, 63*b*. Power line 65 coupled to hydraulic cylinder 64 may be energized for selectively locking the brake.

Thus the operation of memory means 60 is accomplished as follows. Rotary platform 30 is initially positioned at a desired position of rotation, such as that required for drilling the hole A. The upper latch part 51 is placed in alignment with the lower latch part 52 and the latch parts are interengaged by means of the bolt 53 and striker plate 54. Brake 62 is powered to assume its locked position. The action of the brake fastens the upper latch part 51 upon the track 61 in a selected circumferential position thereon. This locked position of the upper latch part constitute a stored memory of the selected position of the drilling rig, and it also provides an indication of the remembered position since the striker plate 54 is permanently fastened to the upper latch part 51. The two latch parts may be disengaged by withdrawing the bolt 53, and the rotary platform 30 may then be rotated to another position, such as the position corresponding to dump site B, and when the rotary platform is later returned to its original position the latching means 50 will act automatically to lock the rotary platform in place.

Disengagement means 70 is provided for disengaging the latch parts. It includes a hydraulic cylinder 71 which is attached between bolt 53 and lower latch part 52, together with a power line 72 for selectively actuating the cylinder. When power line 72 is energized the bolt is withdrawn from the striker plate as shown in FIG. 12. Sufficient rotation of the rotary platform 30 is then permitted to take place while the power line remains energized so that the release of the bolt will not cause it to engage the striker plate. Thereafter, when the power line has been de-energized further rotation of the rotary platform will cause the bolt to re-engage the striker plate, as previously described.

Figure 6:
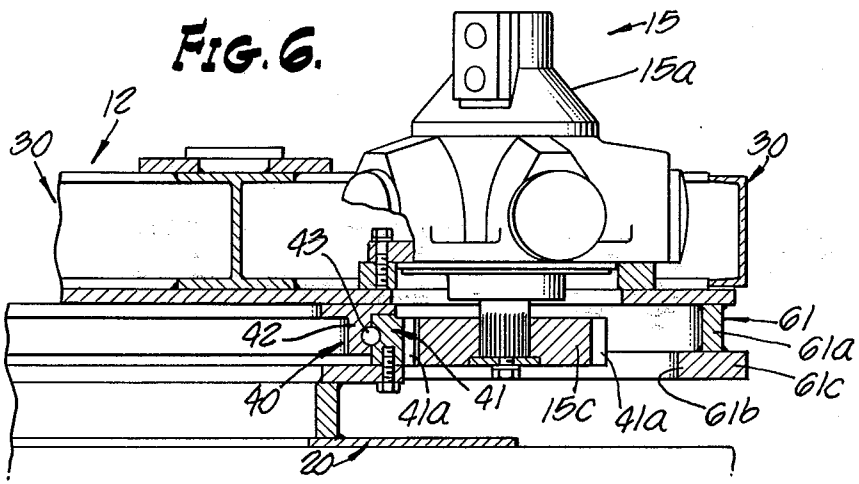
FIG. 6 is a fragmentary cross-sectional view taken on line 6—6 of FIG. 4.

Machine 10 also includes power drive means 15 for causing the rotary platform to rotate. A pair of drive motors 15*a*, 15*b* are carried by the rotary platform 30 and have downwardly extending shafts to which the respective pinion gears 15*c*, 15*d* are affixed. Ring 41 that is fastened to the stationary platform or base 20 has gear teeth 41*a*, formed on its outer circumference, providing a bull gear. Motors 15*a*, 15*b* are powered in unison. The pinion gears 15*c*, 15*d* engage the bull gear 41*a*, and therefore drive the rotary platform 30 in a rotary movement about the common axis of the rings 41, 42 (FIGS. 3, 4, 6).

Figure 3:
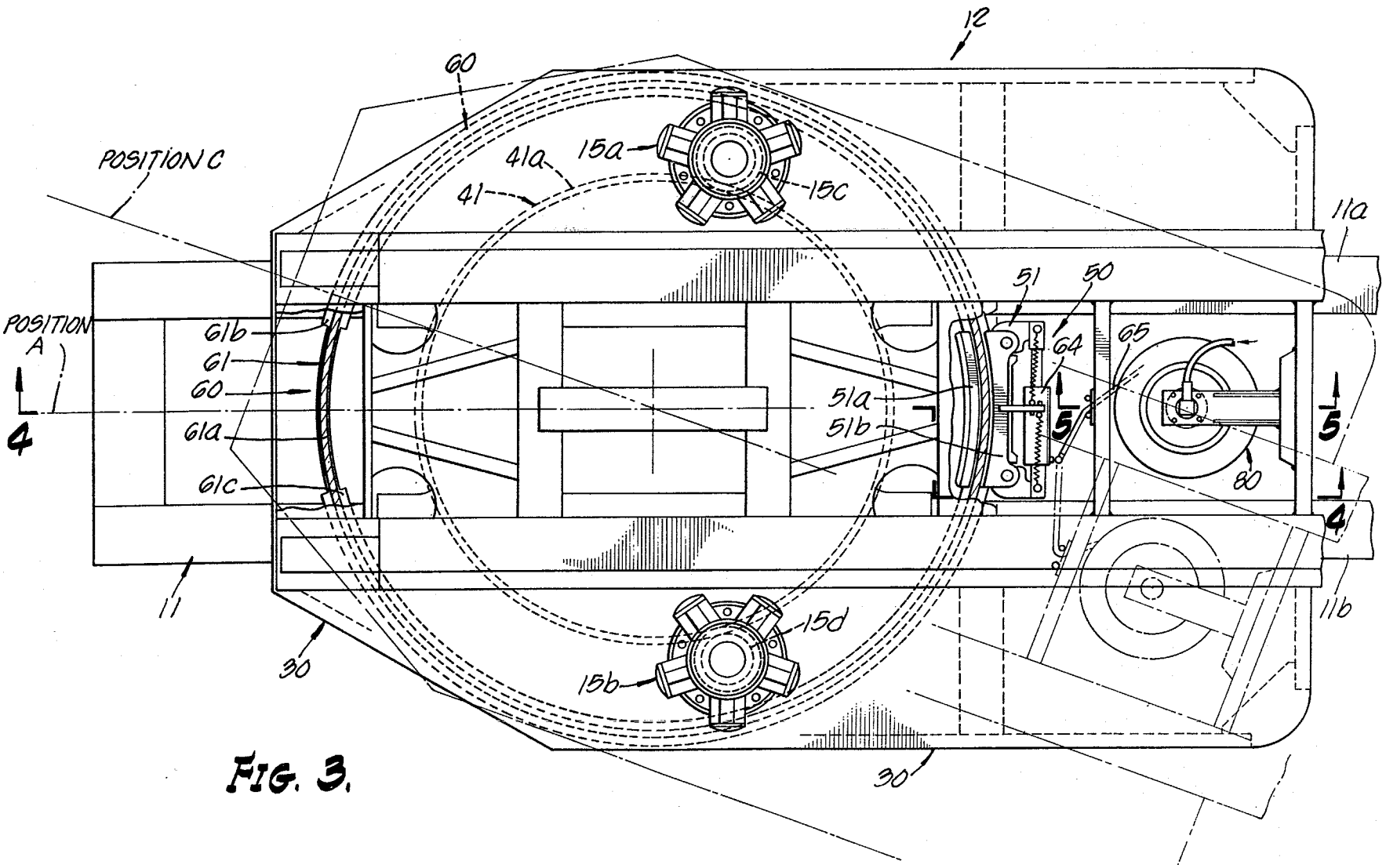
FIG. 3 is an enlarged top plan view of the rotatable platform of FIG. 1 shown partially in cross-section.

Referring specifically to FIGS. 2 and 3, it will be seen that the platform 30 includes a parallel pair of bed portions 30*a* and 30*b*. Derrick 13 may be moved longitudinally on the platform portions 30*a*, 30*b*, but in the present illustration it is assumed that the derrick remains in a fixed position on the platform.

Figure 4:
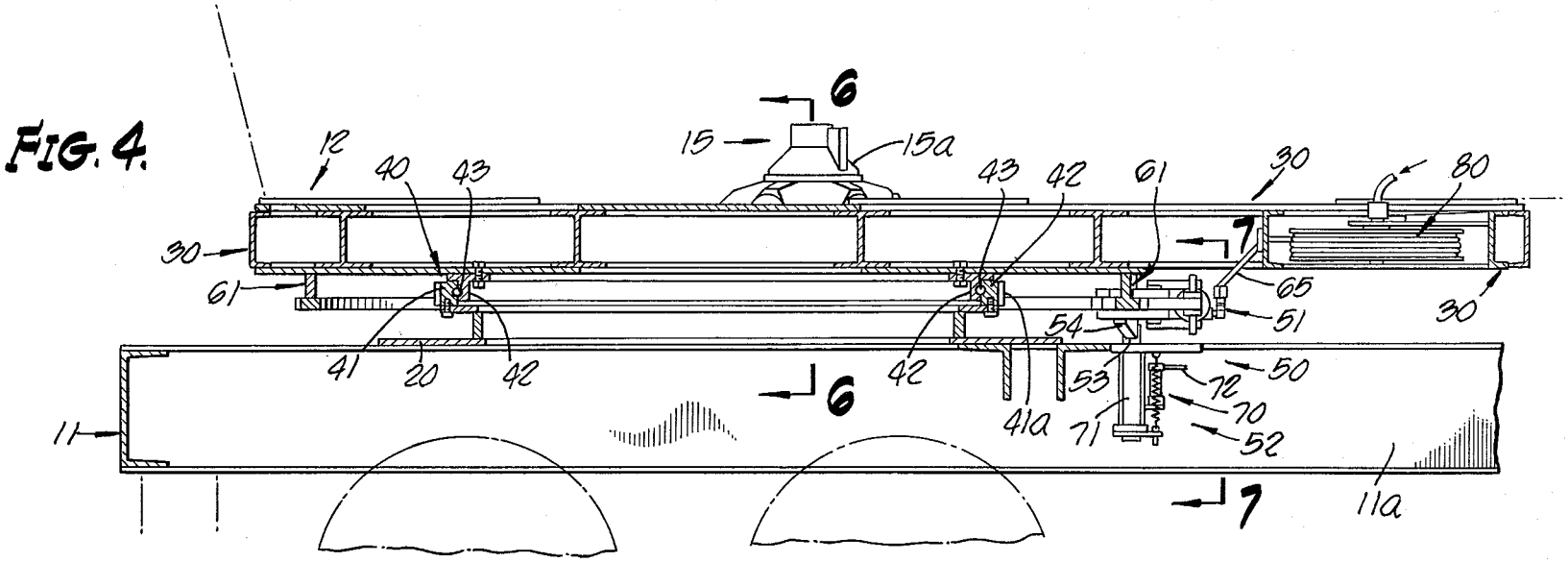
FIG. 4 is a longitudinal cross-sectional view of the rotatable platform and carrier, taken on line 4—4 of FIG. 3.
Figure 5:
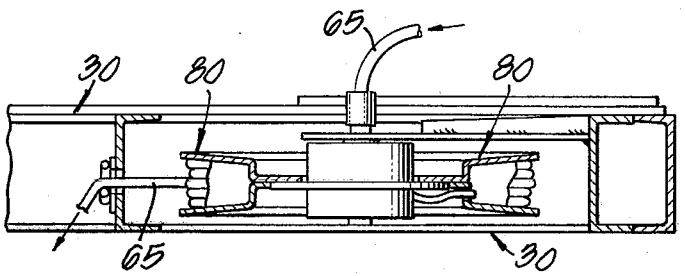
FIG. 5 is a fragmentary cross-sectional view taken on line 5—5 of FIG. 3.

Referring now to FIGS. 3, 4, and 5, it will be seen that a spool 80 carried within one end of the rotary platform 30 is utilized for storing a length of the power line or hose 65. The hydraulic pressure in hose 65, coupled to cylinder 64, is selectively released in order to release the brake 62 which in turn permits the upper latch part or clamp 51 to float freely relative to the rotary platform 30. Particularly when a new position is being sought, such as the drilling position for hole C, the upper latch part or clamp must remain fastened to the lower latch part 52 but must slide circumferentially on the track 61. As previously pointed out, this constitutes the erasure of one position such as hole A from the memory, and the storage in memory of a new position such as hole C. This repositioning of the clamp, however, requires the hose 65 to be either paid out or pulled in, as the case may be. This is the function of the hose reel 80, therefore, to make necessary adjustments in the length of the hose 65.

It is not necessary to adjust the length of hydraulic line 72, because lower latch part 52 remains in a fixed position on the carrier 11 at all times.

Referring now to FIGS. 7 through 15, inclusive, the structure of the automatic latching means 50, of the memory means 60, and of the disengagement means 70, will be more specifically described. The first latch part 51, also known as the upper latch part or as the clamp assembly, will be described first.

CLAMP ASSEMBLY

The clamp assembly 51 is shown in whole or in part in each of the drawing FIGS. 7 through 10, inclusive, and 12 through 15, inclusive.

As previously explained, the upper latch part or clamp assembly 51 is slidably mounted upon the circular track 61 so that it can be stationed at any selected position around the circumference of the rotary platform 30. Circular track 61 has a ring-shaped base portion 61a which is welded underneath the rotary platform 30 and extends downwardly therefrom. At the lower edge of base portion 61*a* there is a horizontal flange 61*b* which extends inwardly of the rotary platform and a horizontal flange 61*c* which extends outwardly from the rotary platform. Thus, the circular track 61 has a T-shaped cross-sectional configuration. See FIGS. 9 and 10.

The base portion of the upper latch 51 is fabricated by welding a set of five plates together. A bottom plate 100 fits underneath the track flanges 61*b*, 61*c*. This plate has a somewhat elongated rectangular configuration, but more specifically, its inner edge surface 100*a* is concavely rounded so that at all points along its length it projects somewhat inwardly of the track flange 61*b*. Its outer edge surface 100*b* is straight throughout most of its length, but on its two ends has outwardly extending ears which provides pivotal support for the brake cams 62*a*, 62*b*. An inner plate 101 is curved in the same manner as the inner edge 100*a* of plate 100. The inner plate 101 slides along the inner circumferential wall of track flange 61*b*. It is positioned on top of the inner edge of bottom plate 100 and is securely welded thereto. An outer plate 102 fits around the outer circumferential wall of the track flange 61*c*, rests upon the outer edge of the bottom plate 100, and is securely welded to the plate 100. The inner finger 51*a* slides upon the upper surface of the track flange 61b and extends inwardly from the track. It is securely welded to the inner plate 101. In similar fashion the outer finger 51b slides upon the upper surface on the track flange 61*c*. It extends over the outer plate 102 and is securely welded to it.

Thus it will be seen that the base portion of the clamp assembly, consisting of bottom plate 100, inner plate 101, outer plate 102, inner finger 51*a*, and outer finger 51*b*, is adapted to slide to any desired circumferential position on the T-shaped circular track 61. Striker plate 54 is welded to the undersurface of the bottom plate 100 and extends downwardly therefrom. See FIGS. 9, 10, 12 and 14. The striker plate therefore moves with the base portion of the clamp assembly.

The upper finger 51*b* also has outwardly extending ears on its ends, corresponding to the ears on the outer edge of the bottom plate 100. A vertical cam shaft 105 extends between the ears on one end of the clamp assembly while a vertical cam shaft 106 extends between the ears on the other end. Cam shaft 105 supports the brake cam 62*a* for rotation while the cam shaft 106 supports the brake cam 62*b*. A parallel pair of spring mounting plates 107, 108 are disposed in a vertical plane, with their inner ends being welded above the outer finger 51*b* and below the bottom plate 100, respectively. See FIGS. 9, 10, and 12 to 14. There are a parallel pair of springs 63*a*. The upper spring has one end pinned to the spring plate 107 while the other end is pivotally secured to a vertical pin 109 which is carried by the outer end of brake cam 62*a*. The lower one of the springs 63*a* has one end pinned to the spring plate 108 while its other end is pivotally secured to the lower end of the pivot pin 109. In similar fashion there are a pair of the springs 63*b*, the inner ends of these springs being pinned to the spring plates 107, 108, respectively, while their outer ends are pivotally secured to the respective ends of a vertical pivot pin 110 which is carried on the outer end of brake cam 62*b*.

Thus the spring pairs 63*a*, 63*b* provide a biasing force which pulls the outer ends of the brake cams 62*a*, 62*b* towards the center of the clamp assembly. The braking portion of each of the brake cams 62*a*, 62*b* is a semicircular plate which is eccentrically mounted upon its respective pivot pin 105, 106. It will be seen that the inner plate 102 is normally spaced a short distance away from the outer circumferential wall of the track flange 61*c* (FIGS. 10, 13, 15) and this spacing allows for a small radially inward movement of the base assembly of the clamp whenever the brake is released to permit the sliding movement of the clamp around the track.

Power cylinder 64 has an attached pair of hinge plates 64*a*, 64*b* disposed respectively above and below the outer end portion of the brake cam 62*a*, being pivotally secured to the brake cam by the pivot pin 109. The associated piston 64*c* has on its outer end a pair of hinge plates 64*d*, 64*e*, which are similarly coupled to the outer end of the brake cam 62*b* by means of the pivot pin 110.

Operation of the clamp assembly is as follows. Springs 63*a*, 63*b* normally bias the braking cams towards their unlocked position. The power cylinder 64 is of the single-action type. A control valve at the operator's location (not shown) is used to selectively supply oil under pressure to the power hose 65. Admission of pressure into the cylinder 64 causes the piston 64*c* to travel outward, expanding the outer ends of the brake cams and causing them to lock against the track flange 61*c*. A breather valve 66 on the outer end of cylinder 64 provides an air filter for the flow of air either inwardly or outwardly from the outer end of the cylinder, as oil pressure is either applied to or withdrawn from the powered end of the cylinder. Thus the operator of the machine must continue to supply oil pressure to the cylinder 64 so long as the clamp assembly is remembering a particular platform position. When the oil pressure is released, the braking cams will automatically unlock from the track, and the memory information is lost.

LOWER LATCH PART

Lower latch part 52 is constructed as follows. A fixed upper plate 120 is permanently attached to the carrier 11. See FIGS. 9, 10, 12 and 14. A rear plate 121 and a front plate 122 are spaced apart in parallel relationship, being vertically disposed with their upper ends secured to the fixed upper plate 120. A pair of spacer blocks 123, 124 which extend vertically between the plates 121, 122 are best seen in FIG. 11. The bolt 53 is housed within the walls 121, 122 and spacer blocks 123, 124 in vertical sliding relationship therewith. In the central portion of its length the bolt 53 is hollow, as best seen in FIGS. 10 and 11. A fixed lower plate 125 is welded to the lower ends of the walls 121, 122 and the spacing blocks 123, 124 (FIG. 10), but having an opening through which the lowermost end of the bolt 53 projects downwardly.

Figure 14:
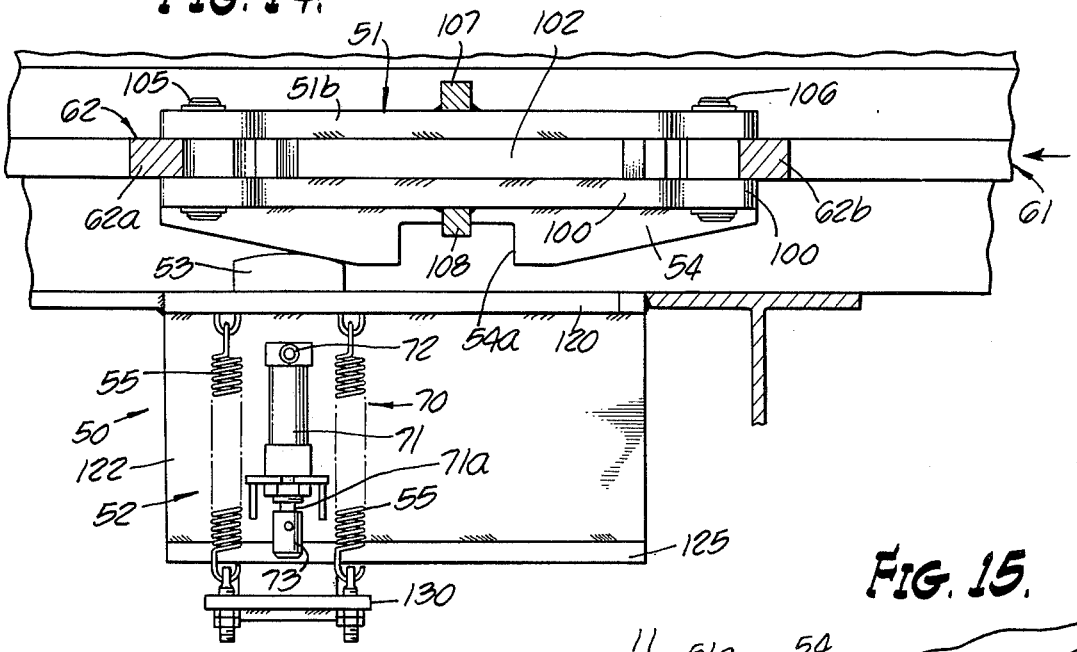
FIG. 14 is a view somewhat similar to FIG. 12, but showing the latch parts about to interengage as the rotatable platform approaches its initial or locking position.
Figure 15:
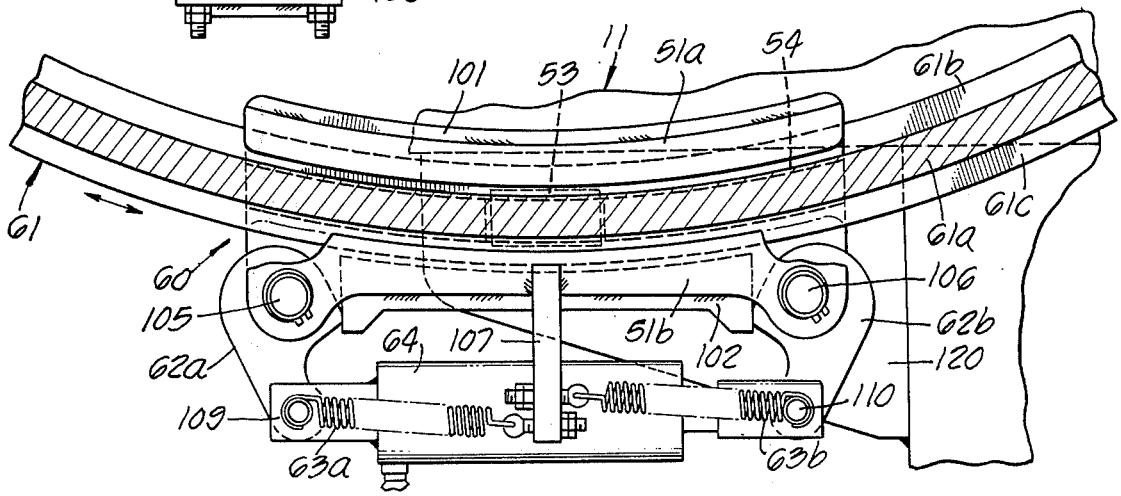
FIG. 15 is a top plan view of the upper latch part showing the brake or memory device unlocked to permit the selection of a new initial position of the rotatable platform.

A movable plate 130 is horizontally disposed and extends around and is welded to the lower end of the bolt 53 (FIG. 10). A pair of bolt springs 55 are tension springs which extend vertically one on each side of the bolt 53. The lower end of springs 55 is hooked to the movable plate 130 while their upper ends are hooked to the fixed plate 120. Thus the normal operation of the bolt springs 55 is to maintain the movable plate 130 at the upper limit position of its movement, and consequently to maintain the bolt 53 in its upward or latched position. This is the position of the mechanism as shown in FIGS. 7 through 11, inclusive FIG. 12 shows the bolt when fully retracted and FIG. 14 shows the bolt when partially retracted.

DISENGAGEMENT MEANS

Figure 7:
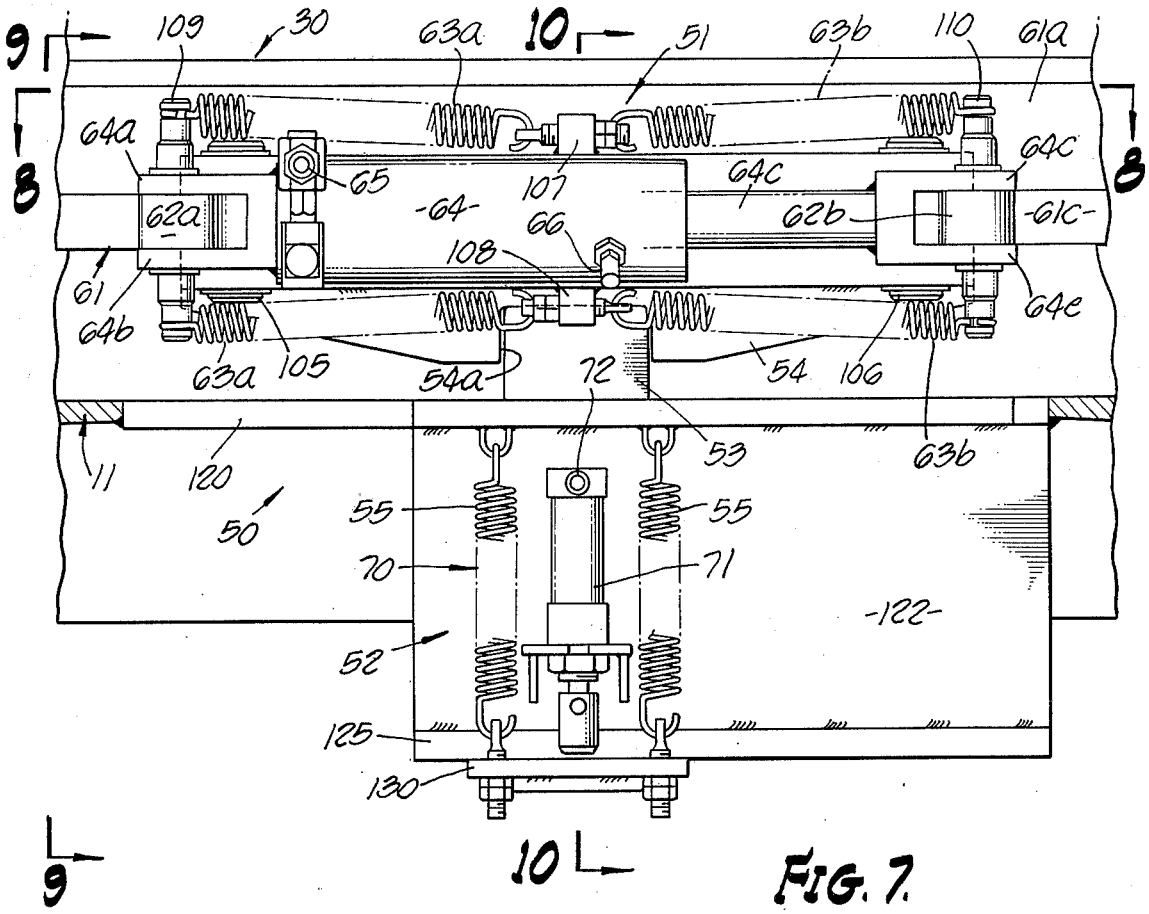
FIG. 7 is an enlarged fragmentary view taken on the line 7—7 of FIG. 4.
Figure 8:
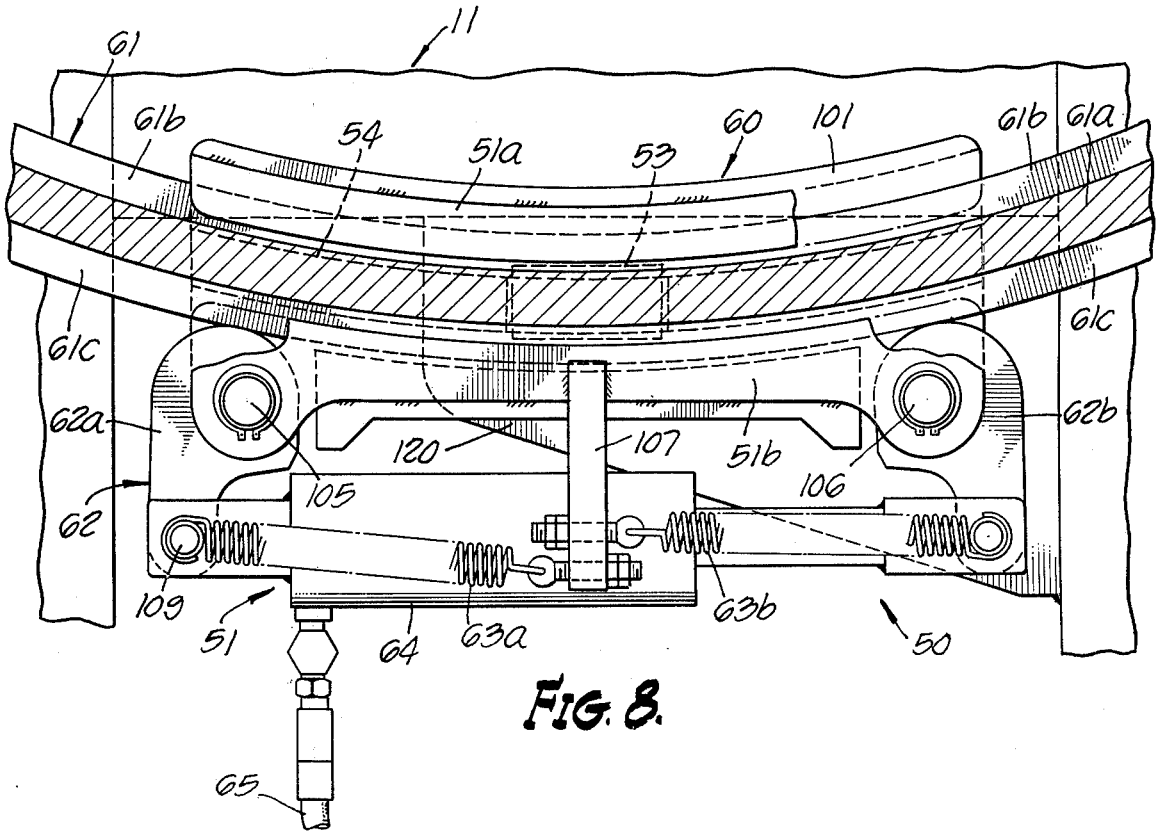
FIG. 8 is a top plan view of the latch mechanisms looking down on the line 8—8 of FIG. 7.
Figure 13:
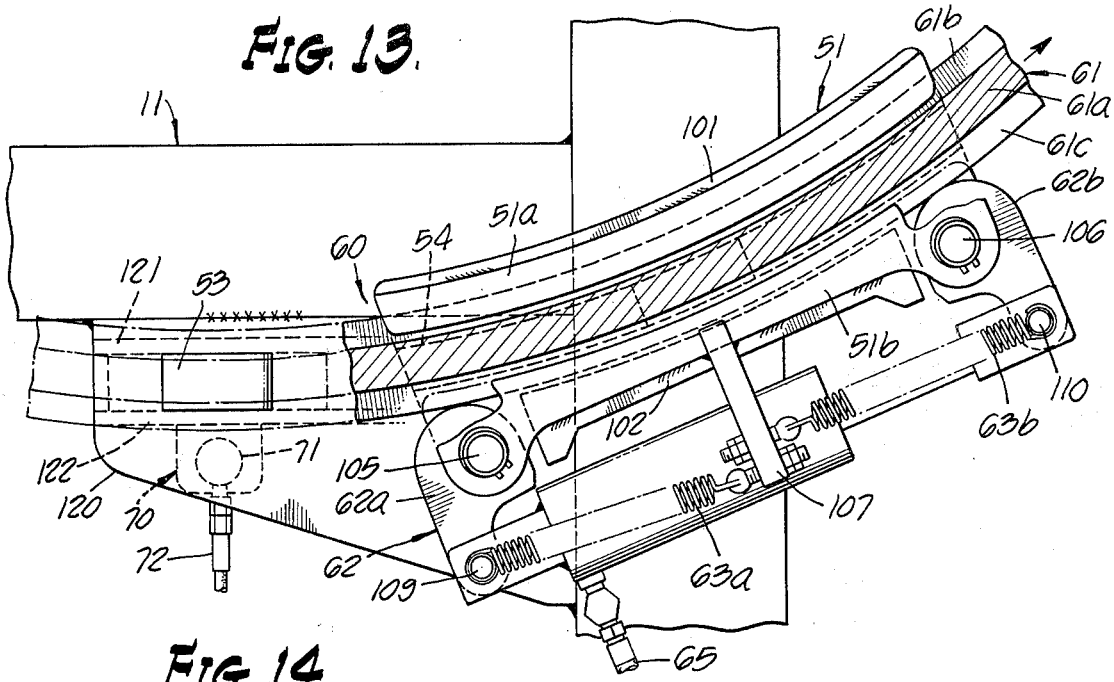
FIG. 13 is a view somewhat similar to FIG. 8 but showing the rotatable platform partially rotated so that the upper latch part is out of alignment with the lower latch part.

Power cylinder 71 is permanently mounted in front of the wall 122 and below the fixed plate 120. Piston 71*a* extends downwardly from the cylinder 71. A plunger 73 having substantial weight is attached to the lower end of the piston 71*a*. Plunger 73 is normally spaced a short distance above the movable plate 130, as best seen in FIGS. 7 and 10.

When the two latched parts are to be selectively disengaged, the operation is as follows. The operator opens a control valve (not shown) so as to supply oil under pressure through the hose 72 into the upper end of cylinder 71. The cylinder 71 is, like cylinder 64, a single-action cylinder. The pressurized oil forces the piston 71a downward, and plunger 73 strikes the upper surface of movable plate 130 with considerable momentum. The holding action of springs 55 is overcome, and latch bolt 53 moves downward to its open position. The open position of the bolt is shown in dotted lines in FIG. 9 and in solid lines in FIG. 12.

The oil pressure supplied to cylinder 71 is then maintained at least for a period of time, until the rotary platform 30 has been rotated a sufficient distance so that the latch bolt 53 is placed completely out of engagement with the striker plate 54. The oil pressure may then be released, and latch bolt 53 will return to its upward position. Upon further rotation of platform 30 the upper end of latch 53 will engage one end of the striker plate 54 as shown in FIG. 14, and continued rotation of platform 30 causes the bolt to be depressed against the force of springs 55. When the two latch parts become circumferentially aligned, however, the bolt travels upward to occupy the central notch 54*a* in the striker plate. An interengagement or locking action between the upper latch part 51 and the lower latch part 52 has then been achieved.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A rotary platform assembly that is adapted for automatic repositioning of the platform at a selected rotary position, comprising:

a base;

a rotary platform mounted upon said base for rotation thereon;

a circular track fixedly secured to one of said base and platform;

a first latch part mounted upon said circular track and circumferentially movable thereon independently of both said base and said platform;

a second latch part fixedly secured to the other of said base and platform, said two latch parts being adapted to automatically interengage when relative rotation of said platform and base in either direction brings the circumferential positions of said latch parts into coincidence;

memory means selectively operable for locking said first latch part at a selected circumferential position on said track, whereby said platform may initially be latched at a desired rotational position; and means for selectively disengaging said two latch parts whereby said platform may be freed for rotation to some other desired rotational position, and upon being further rotated will automatically be latched when it again reaches its initial position.

2. The rotary platform assembly of claim 1 wherein said circular track is fixedly secured to said rotary platform.

3. A rotary platform assembly as claimed in claim 1 which further comprises interengagement means for said latch parts, including a spring-loaded latch bolt carried by one of said latch parts and a striker plate carried by the other of said latch parts.

4. A rotary platform assembly as claimed in claim 1 which further includes a pair of concentric rings, one secured to said base and the other secured to said rotary platform, and bearing means supporting said rings for relative rotation with respect to each other.

5. A rotary platform assembly as claimed in claim 4 wherein said circular track is concentric with said rings and is of larger diameter than either of said rings.

6. A rotary platform assembly as claimed in claim 1 wherein said track is attached to said rotary platform and extends downwardly therefrom, said second latch part is attached to said base, and said memory means is a remotely controlled brake.

7. A rotary platform assembly that is adapted for automatic repositioning of the platform at a selected rotary position, comprising:

a base;

a rotary platform mounted upon said base for rotation thereon;

a circular track fixedly secured to one of said base and platform;

a first latch part mounted upon said circular track in a circumferentially slidable relationship therewith;

a second latch part fixedly secured to the other of said base and platform, said two latch parts being adapted to automatically interengage when their circumferential positions coincide;

memory means selectively operable for locking said first latch part at a selected circumferential position on said track, whereby said platform may initially be latched at a desired rotational position; and means for selectively disengaging said two latch parts whereby said platform may be freed for rotation to some other desired rotational position, and upon being further rotated will automatically be latched when it again reaches its initial position;

said circular track having a T-shaped cross-sectional configuration including a pair of horizontal flanges, and said first latch part having finger portions engaging said horizontal flanges in slidable relationship therewith.

8. A rotary platform assembly that is adapted for automatic repositioning of the platform at a selected rotary position, comprising:

a base;

a rotary platform mounted upon said base for rotation thereon;

a circular track fixedly secured to said rotary platform and extending downwardly therefrom, said track having a T-shaped cross-sectional configuration including a pair of horizontal flanges;

a first latch part mounted upon said circular track in a circumferentially slidable relationship therewith, said first latch part including a pair of fingers extending about and sliding upon the upper surfaces of said flanges;

a second latch part fixedly secured to said base, said two latch parts being adapted to automatically interengage when their circumferential positions coincide;

and a brake carried by said first latch part and adapted to selectively engage the base portion of said circular track which extends above said horizontal flanges thereof, said brake being remotely controlled and being selectively operable for locking said first latch part at a selected circumferential position on said track, whereby said platform may initially be latched at a desired rotational position; and means for selectively disengaging said two latch parts whereby said platform may be freed for rotation to some other desired rotational position, and upon being further rotated will automatically be latched when it again reaches its initial position.

9. A rotary platform assembly as claimed in claim 8 which further comprises interengagement means including a spring-loaded latch bolt carried by one of said latch parts, and a striker plate carried by the other of said latch parts.

10. In a rotary platform assembly including a base, and a platform upon said base, position indicating and latching means comprising:

a circular track fixedly secured to one of said base and platform;

a first latch part mounted upon said circular track in a circumferentially slidable relationship therewith, said first latch part being adapted to automatically interengage a second latch part that is fixedly secured to the other of said base and platform, when their circumferential positions coincide;

selectively operable means for locking said first latch part at a selected circumferential position on said track; and said circular track being fixedly secured to said platform and depending downwardly therefrom, said circular track having a T-shaped cross-sectional configuration including a pair of horizontal flanges, and said first latch part having finger portions engaging the upper surfaces of said horizontal flanges in slidable relationship therewith.

11. In the process of rotating a rotary platform relative to its supporting base, the method of selecting a normal rotary position of the platform and of automatically returning it to said normal position during its successive rotations, comprising the steps of:

attaching a circular track to one of said platform and base;

placing a first latch part in circumferentially slidable relationship upon said track;

placing a second latch part in a fixed circumferential position on the other of said platform and base;

lockingly interengaging said two latch parts;

while said latch parts remain locked together, rotating said platform to the selected normal rotary position, and then locking said first latch part to said track so that it is no longer free to slide thereon;

thereafter unlocking said two latch parts from each other, and rotating the platform away from its normal position; and when further rotation of the platform has again brought it to its normal position, again locking said two latch parts to each other.

12. In a rotary platform assembly including a base, a platform rotatable on said base, and a circular track carried by one of said platform and base, apparatus for automatically re-establishing a preselected rotary position of the platform, comprising:

a first latch part carried on said circular track and circumferentially slidable thereon;

brake means cooperatively associated with said first latch part and operable for locking said first latch part to said track;

a second latch part carried in a fixed position on the other of said platform and base, said two latch parts being adapted to automatically interengage and lock whenever their circumferential positions come into coincidence in either direction of rotation of said platform;

first remotely controlled means selectively operable for locking said brake means so that said first latch part is not free to slide on said track; and second remotely controlled means selectively operable for causing said two latch parts when locked to become disengaged, in order that said platform may again rotate after being locked in its preselected rotary position;

said first control means being utilized for retaining memory of an initially preselected position, and said second control means being utilized each time said platform is repositioned to said initially preselected position.

13. Apparatus as in claim 12 wherein one of said latch parts includes a spring-loaded bolt which is axially movable in a direction perpendicular to the plane of rotation of said rotary platform, and the other of said latch parts includes a two-sided striker plate which is engageable from either end thereof by said bolt.

14. Apparatus as in claim 12 wherein said track is attached to said platform, said first latch part is slidable on top of said track, and said second latch part is fixedly attached to said base.

15. In a rotary platform assembly including a base, a platform rotatable on said base, and a circular track carried by one of said platform and base, position control means comprising:

a first latch part carried on said track and circumferentially slidable thereon;

brake means associated with said first latch part and selectively operable for locking said first latch part to said track;

a second latch part carried in a fixed position on the other of said platform and base;

one of said latch parts being a striker plate having two opposing sloped ends which lie in a plane parallel to said track and also having a notch between said ends, the other of said latch parts being a spring-driven bolt which extends perpendicular such that as said platform rotates and approaches circumferential coincidence of said latch parts, said bolt first rides on one of said sloped ends and then engages said notch; and remotely controlled means for retracting said bolt.

16. In a rotary platform assembly including a base, a platform on said base, and a circular track carried by one of said platform and base, apparatus for automatically re-establishing a preselected rotary position of the platform, comprising:

a first latch part carried on said circular track and circumferentially slidable thereon;

brake means cooperatively associated with said first latch part, including spring means normally retaining same in unlocked position, and operable for locking said first latch part to said track;

a second latch part carried in a fixed position on the other of said platform and base, said two latch parts being adapted to automatically interengage and lock whenever their circumferential positions come into coincidence in either direction of rotation of said platform;

first remotely controlled means selectively operable for locking said brake means so that said first latch part is not free to slide on said track; and second remotely controlled means selectively operable for causing said two latch parts when locked to become disengaged, in order that said platform may again rotate after being locked in its preselected rotary position;

said first control means being utilized for retaining memory of an initially preselected position; and said second control means being utilized each time said platform is repositioned to said initially preselected position.

17. In a rotary platform assembly including a base, and a platform rotatable upon said base, position indicating and locking means comprising:

a circular track fixedly secured to one of said base and platform;

a first latch part mounted upon said circular track and movable circumferentially thereupon independently of both said base and said platform;

selectively operable means for locking said first latch part at a selected circumferential position on said track, thereby providing memory of a position to which said platform is to return;

a second latch part fixedly secured to the other of said base and platform; and means associated with said two latch parts and operable when said latch parts are moved into circumferential coincidence for causing said latch parts to automatically interengage and lock.

18. A rotary platform comprising:

a base;

a platform rotatable on said base;

a pair of latch parts carried by respective ones of said base and platform, and including means responsive when the circumferential positions of said latch parts are brought into coincidence for automatically causing said latch parts to interengage and lock, thereby locking said platform in a fixed rotational position;

a circular track carried by one of said base and platform, the associated latch part being supported thereon and movable therearound independently of both said base and said platform, whereby said associated latch part may be selectively positioned upon said track in accordance with a rotational position in which it is desired to lock said platform; and selectively operable means for locking said associated latch part in its selected position, so that when said platform is rotated it will automatically be locked in said desired rotational position.

19. A rotary platform assembly as claimed in claim 7 wherein said memory means includes a brake that is selectively engageable with the base portion of said track.

20. Apparatus as claimed in claim 10 wherein said locking means includes cam means operable for engaging the vertical wall of one of said track flanges.

* * * * *